US012514306B2

(12) United States Patent
Belkadi

(10) Patent No.: US 12,514,306 B2
(45) Date of Patent: Jan. 6, 2026

(54) SAFETY SWIMSUIT WITH FLOATS MADE OF POLYMER FIBRES ENCLOSING A GAS

(71) Applicant: GREYSTONE, Carros (FR)

(72) Inventor: Alain Belkadi, Villefranche-sur-Mer (FR)

(73) Assignee: GREYSTONE, Carros (FR)

( * ) Notice: Subject to any disclaimer, the term of this patent is extended or adjusted under 35 U.S.C. 154(b) by 401 days.

(21) Appl. No.: 18/177,553

(22) Filed: Mar. 2, 2023

(65) Prior Publication Data

US 2023/0276867 A1 Sep. 7, 2023

(30) Foreign Application Priority Data

Mar. 3, 2022 (FR) ..... 2201868

(51) Int. Cl.
*A41D 7/00* (2006.01)

(52) U.S. Cl.
CPC ..... *A41D 7/003* (2013.01)

(58) Field of Classification Search
CPC ..... A41D 7/003
See application file for complete search history.

(56) References Cited

U.S. PATENT DOCUMENTS

| | | | | |
|---|---|---|---|---|
| 267,799 | A | * | 11/1882 | Plant |
| 4,952,352 | A | | 8/1990 | Shin |
| 6,405,375 | B1 | | 6/2002 | Sardi |

FOREIGN PATENT DOCUMENTS

| | | | |
|---|---|---|---|
| KR | 200218542 | Y1 | 4/2001 |
| WO | 1999059437 | A1 | 11/1999 |

* cited by examiner

*Primary Examiner* — Stephen P Avila
(74) *Attorney, Agent, or Firm* — Vorys, Sater, Seymour and Pease LLP; Rex W. Miller, II

(57) ABSTRACT

One-piece safety swimsuit 1, extending from at least the crotch up to the top of the shoulders and comprising buoyancy elements 2, 7 configured to keep a user of the swimsuit 1 above water from the shoulders, each buoyancy element 2, 7 comprising several sheets stacked on top of each other, each sheet being from 1.05 mm to 1.50 mm thick, preferably from 1.10 mm to 1.30 mm thick, even more preferably 1.20 mm thick, said sheets being composed of polymer fibres enclosing a volume of a gas that is greater than the volume of the polymer.

12 Claims, 3 Drawing Sheets

SAFETY SWIMSUIT WITH FLOATS MADE OF POLYMER FIBRES ENCLOSING A GAS

BACKGROUND

The invention relates to a one-piece safety swimsuit, extending from at least the crotch up to the top of the shoulders.

The state of the art already describes such swimsuits. They include built-in buoyancy elements. These buoyancy elements consist of a rectangular parallelepipedic foam insert or float. These buoyancy elements of the state of the art are rigid and are not ergonomic. Consequently, they allow no freedom of movement. Buoyancy is obtained since the floats rise up to the surface, forcing the user to adopt a position which is not necessarily the swimming position. In addition, if the swimsuit is damaged, the float may move, or even be removed, which causes safety problems. Furthermore, floating swimsuits with built-in polystyrene tubes surrounding the trunk and back hinder the movements of the arms and cause a "cork effect" in small children. For small children in fact, the head is the centre of gravity in water. Small users float vertically, but if they tip forwards, the head will be pulled downwards, which may cause the child to turn upside down and make it very difficult to return to an upright position.

SUMMARY

The invention aims in particular to provide a safety swimsuit allowing greater freedom of movement.

The invention therefore relates to one-piece safety swimsuit, extending from at least the crotch up to the top of the shoulders and comprising:

a main swimsuit part, and buoyancy elements each arranged on a portion of the main swimsuit part and configured to keep a user of the swimsuit above water from the shoulders, each buoyancy element comprising several sheets stacked on top of each other, each sheet being from 1.05 mm to 1.50 mm thick, preferably from 1.10 mm to 1.30 mm thick, even more preferably 1.20 mm thick. Said sheets are composed of polymer fibres enclosing a volume of a gas that is greater than the volume of the polymer.

Thus, the polymer fibres enclose mostly gas, in other words over 80% of the fibre volume consists of gas, preferably over 95%, and even more preferably 97% or more.

The polymer fibres are obtained by extruding the polymer in the presence of a foaming agent so as to form cavities in the polymer, and by injecting a gas which is then trapped in the cavities.

Thus, the gas is trapped in the polymer fibre, according to a method described for example in U.S. Pat. No. 4,952,352.

The sheets, which are therefore thin, are relatively flexible and follow the body movements for optimum comfort. They are more ergonomic. The invention therefore prevents some areas from rising up to the surface and the user can float in the horizontal position. Buoyancy is neither insufficient nor excessive, the user therefore has to stimulate their motor function to move and float, which will eventually help them to learn the swimming movements.

In addition, tests have demonstrated that a cut in the buoyancy element according to the invention does not affect the buoyancy of the swimsuit. In the swimsuit according to the invention, the entire swimsuit floats. Thus, there is no risk of the swimsuit rising above the user's head, as can be observed with floats.

Moreover, a large quantity of gas can be stored in a thickness of approximately 1.2 mm. Thus, a 1.2 mm thick sheet encloses 2.4 times more gas than a 0.5 mm thick sheet. Using 1 mm to 1.5 mm thick sheets reduces the number of sheets in the buoyancy element, compared with a solution in which the sheets would for example be 0.5 mm thick. This results in better buoyancy and reduced thickness, thereby providing greater freedom of movement for the user.

According to the invention, the main swimsuit part is a piece of fabric extending from at least the crotch up to the top of the shoulders. The buoyancy elements are each arranged on a portion of the main swimsuit part, in other word they occupy one or more portions of the main part, while other portions of the main part are not occupied by a buoyancy element. In other words, the buoyancy elements are not arranged entirely over the main part. The buoyancy elements are thus arranged so as to provide the user with buoyancy offering freedom of movement in order to swim. The number of buoyancy elements, their location on the main swimsuit part, and the number of sheets they comprise can be chosen to adapt the swimsuit to the user's weight.

According to the invention, a buoyancy element "arranged on" a portion of the main part may mean that the buoyancy element is arranged inside the main part.

According to other optional characteristics of the swimsuit, taken alone or in combination:

The polymer is an ethylene polymer, preferably an ethylene homopolymer, and even more preferably low-density polyethylene.

"Ethylene polymer" means a polymer mainly comprising ethylene monomers. The polymer can be a homopolymer, in which case it will comprise ethylene as sole repeat unit, or an ethylene copolymer, comprising a second repeat unit such as propylene.

Low-density polyethylene (LDPE) is an ethylene homopolymer. It has a relative density of approximately 0.92. The buoyancy is therefore improved. In addition, this polymer is known to be highly flexible and can be used to manufacture flexible products. This polymer is therefore especially adapted to improve the swimsuit ergonomics. This polymer can also be recycled and is non-toxic. It is used, for example, in food packaging. It is also very strong and is used to manufacture objects capable of withstanding impacts, such as boat hulls or bullet-proof vests. It can also be given anti-UV treatment to withstand long exposure to sunlight, which is advantageous for outdoor bathing.

The gas is air or natural gas.

The buoyancy properties of air are well known and natural gas, which is a mixture of gaseous hydrocarbons composed mainly of methane, is lighter than air, thus producing a polymer sheet of even greater buoyancy. Natural gas also offers the advantage of not being polluting.

The swimsuit is configured to be worn by a child, and the buoyancy elements each comprise from four to fifteen sheets (13). In addition, the swimsuit comprises at least:

a buoyancy element extending on a front side of the swimsuit, and configured to cover the top part of the child's body, and comprising from fourteen to fifteen sheets, and a buoyancy element extending on a rear side of the swimsuit, and configured to cover an area extending from the child's pelvis up to the top of the shoulders, and comprising from seven to ten sheets.

The number of buoyancy elements, their location on the swimsuit, and the number of sheets they comprise can be chosen to adapt the swimsuit to the child's weight, to provide suitable buoyancy.

The swimsuit is configured to be worn by a child weighing between 13 and 19 kg, and further comprises:

a buoyancy element extending on a front side of the swimsuit, and configured to cover the child's waistline, and comprising four sheets, a buoyancy element extending on a rear side of the swimsuit, and configured to cover the child's waistline, and comprising seven or eight sheets.

The buoyancy element extending on a rear side of the swimsuit, and configured to cover the waistline, is superimposed on the buoyancy element covering the area extending from the pelvis up to the top of the shoulders.

The swimsuit is configured to be worn by a child weighing between 13 and 15 kg, and further comprises a buoyancy element extending on a rear side of the swimsuit, and configured to cover an area of the child's biceps, and comprising twelve sheets.

The swimsuit is configured to be worn by a child weighing between 15 and 19 kg, and further comprises a buoyancy element extending on a rear side of the swimsuit, and configured to cover the child's nape, and comprising four sheets.

The buoyancy element extending on a rear side of the swimsuit, and configured to cover the nape, is superimposed on the buoyancy element covering the area extending from the pelvis up to the top of the shoulders.

The swimsuit is configured to be worn by a child weighing between 19 and 21 kg, and further comprises a buoyancy element extending on a rear side of the swimsuit, and configured to cover the child's nape, and comprising four sheets.

The swimsuit is configured to be worn by an adult, and the buoyancy elements comprise from six to ten sheets, and the swimsuit comprises:

a buoyancy element extending on a front side of the swimsuit, and configured to cover an area extending between the pelvis and chest of the adult's body, and comprising from nine to ten sheets, and a buoyancy element extending on a rear side of the swimsuit, and configured to cover an area extending between the pelvis and the shoulder line of the adult, and comprising six sheets.

The buoyancy elements are inserted in the swimsuit, in other words they are arranged on an internal surface of the main swimsuit part.

The buoyancy elements are assembled to the main swimsuit part by stitching.

The sheets are stitched together.

The gas is enclosed in the polymer in the form of microbubbles. By stretching under very high pressure, the polymer forms cavities trapping microbubbles of gas. Since the size of these microbubbles varies, the final thickness of the polymer fibre may vary slightly.

The invention also relates to a floating mattress configured to support at least one user on the water, comprising two sheets stacked on top of each other, each sheet being approximately 5 mm thick, said sheets consisting of polymer fibres enclosing a volume of a gas that is greater than the volume of the polymer.

Thus, the polymer fibres enclose mostly gas, in other words over 80% of the fibre volume consists of gas, preferably from 80% to 85%.

The polymer fibres in the floating mattress are obtained by a method similar to that used to manufacture the fibres of the swimsuit described above.

The floating mattress according to the invention offers the advantage of being thin, while providing good buoyancy performance. Using sheets of approximately 5 mm thick reduces the number of sheets in the mattress, compared with a solution in which the sheets would be, for example, 0.5 mm thick. The mattress is therefore more rigid, and new water games can then be created.

According to other optional characteristics of the floating mattress, taken alone or in combination:

The polymer is an ethylene polymer, preferably an ethylene homopolymer, and even more preferably low-density polyethylene.

The gas is air or natural gas.

The gas is enclosed in the polymer in the form of microbubbles.

BRIEF DESCRIPTION OF THE FIGURES

The invention will be better understood on reading the following description, given solely by way of example and with reference to the accompanying drawings in which.

DETAILED DESCRIPTION

Figure 1:
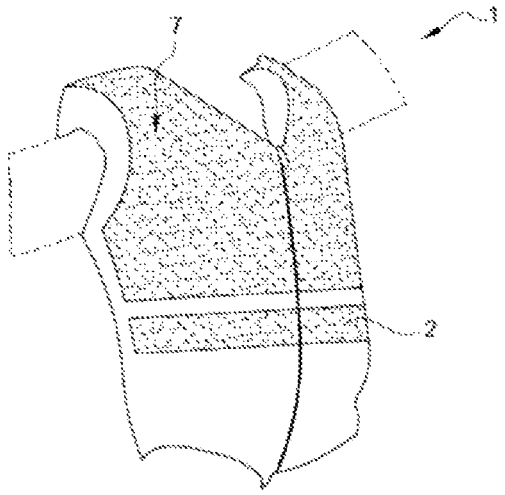
FIG. 1 is a front perspective view of a swimsuit according to a first embodiment of the invention.
Figure 2:
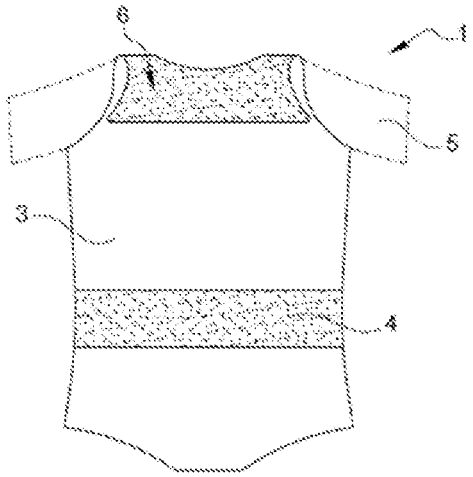
FIG. 2 is a rear perspective view of the swimsuit of FIG. 1.

FIGS. 1 and 2 show a safety swimsuit according to a first embodiment of the invention, designated by the general reference 1. The safety swimsuit 1 is of the one-piece type, extending from at least the crotch up to the top of the shoulders. The swimsuit 1 comprises a main swimsuit part and buoyancy elements each arranged on a portion of the main swimsuit part. The main part gives the swimsuit its general shape. Consequently, the main part is also designated by reference 1 on the figures. The swimsuit 1 may comprise different buoyancy elements depending on the weight of the child. The location of the buoyancy elements on the swimsuit 1 is identified by references 2, 3, 4, 5, 6, 7. The buoyancy elements 2, 3, 4, 5, 6, 7 are configured to keep a user, not shown, wearing the swimsuit 1, above water from the shoulders. The buoyancy elements 2, 3, 4, 5, 6, 7 extend on an internal surface of a front or rear side of the main part 1 of the swimsuit 1.

Figure 3:
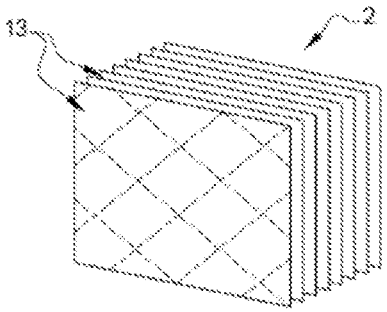
FIG. 3 is an exploded front perspective view of a part of a buoyancy element for the swimsuit of FIG. 1.

As shown on FIG. 3, which illustrates a part of the buoyancy element 2 of FIG. 1, a buoyancy element according to the invention comprises several sheets 13 stacked and stitched on top of each other. In the example shown on FIG. 3, the buoyancy element 2 comprises eight sheets 13. The other buoyancy elements 3, 4, 5, 6, 7 also comprise several sheets 13 stacked and stitched on top of each other. Each sheet 13 is between 1.05 mm and 1.50 mm thick. Preferably, each sheet is 1.20 mm thick.

Figure 4:
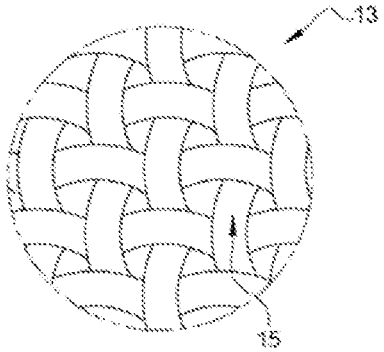
FIG. 4 is a detail view of a sheet of the buoyancy element shown on FIG. 3.
Figure 5:
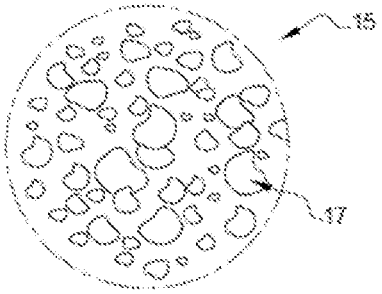
FIG. 5 is a cross-sectional view of a polymer fibre forming the sheet shown on FIG. 4.

As shown on FIG. 4, the sheets 13 consist of polymer fibres 15. FIG. 5 is a cross-sectional view of one of these fibres 15. These fibres 15 enclose a volume of a gas 17 that is greater than the volume of the polymer. The gas is present in the polymer in the form of microbubbles.

In the example shown on FIGS. 1 and 2, the polymer is a low-density polyethylene and the gas 17 is natural gas.

The swimsuit 1 shown on FIGS. 1 and 2 is configured to be worn by a child. The buoyancy elements 2, 3, 4, 5, 6, 7 comprise from four to fifteen sheets 13, and each one is described below.

The buoyancy element 7 extends on a front side of the swimsuit 1, it is configured to cover the top part of the child's body and comprises from fourteen to fifteen sheets 13. Being distributed over the entire top part of the body, the buoyancy element 7 allows the child's body to be positioned horizontally to learn how to swim.

The buoyancy element 3 extends on a rear side of the swimsuit 1, and it is configured to cover an area extending from the child's pelvis up to the top of the shoulders; it comprises from seven to ten sheets 13.

The buoyancy element 2 extends on a front side of the swimsuit 1, it is configured to cover the child's waistline, and comprises four sheets 13.

The buoyancy element 4 extends on a rear side of the swimsuit 1, it is configured to cover the child's waistline, and comprises seven or eight sheets 13. When present, the buoyancy element 4 is superimposed on the buoyancy element 3. The buoyancy element 4 increases the buoyancy of the top of the body.

The buoyancy element 5 extends on a rear side of the swimsuit 1, it is configured to cover an area of the child's biceps, and comprises twelve sheets 13.

The buoyancy element 6 extends on a rear side of the swimsuit 1, it is configured to cover the child's nape, and comprises four sheets 13. When present, the buoyancy element 6 is superimposed on the buoyancy element 3. The buoyancy element 6 keeps the head above water.

The buoyancy elements 2 to 7 are added according to the child's weight, and the number of sheets they contain is also adapted to the child's weight. Thus, the swimsuit 1 shown on FIGS. 1 and 2 comprises at least one buoyancy element 7 comprising fourteen to fifteen sheets 13, and a buoyancy element 3 comprising seven to ten sheets 13.

The following table shows the buoyancy elements, as well as the number of sheets they comprise, depending on the child's weight:

TABLE 1

| Weight | 13-15 kg | 15-17 kg | 17-19 kg | 19-21 kg | 21-24 kg |
|---|---|---|---|---|---|
| Element 7 | 14 sheets | 14 sheets | 14 sheets | 14 sheets | 15 sheets |
| Element 2 | 4 sheets | 4 sheets | 4 sheets | | |
| Element 3 | 10 sheets | 7 sheets | 7 sheets | 7 sheets | 10 sheets |
| Element 4 | 8 sheets | 7 sheets | 7 sheets | | |
| Element 5 | 12 sheets | | | | |
| Element 6 | | 4 sheets | 4 sheets | 4 sheets | |

A swimsuit 1, configured to be worn by a child weighing between 13 and 19 kg, further comprises:

a buoyancy element 2 extending on a front side of the swimsuit 1, and configured to cover the child's waistline, and comprising four sheets 13, a buoyancy element 4 extending on a rear side of the swimsuit 1, and configured to cover the child's waistline, and comprising seven or eight sheets 13.

A swimsuit 1, configured to be worn by a child weighing between 13 and 15 kg, further comprises a buoyancy element 5 extending on a rear side of the swimsuit 1, and configured to cover an area of the child's biceps, and comprising twelve sheets 13.

A swimsuit 1, configured to be worn by a child weighing between 15 and 19 kg, further comprises a buoyancy element 6 extending on a rear side of the swimsuit 1, and configured to cover the child's nape, and comprising four sheets 13.

A swimsuit 1, configured to be worn by a child weighing between 19 and 21 kg, further comprises a buoyancy element 6 extending on a rear side of the swimsuit 1, and configured to cover the child's nape, and comprising four sheets 13.

Figure 6:
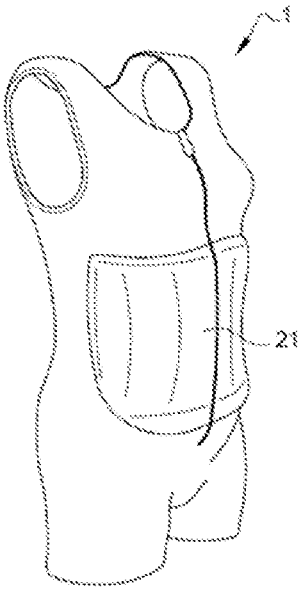
FIG. 6 is a front perspective view of a swimsuit according to a second embodiment of the invention.
Figure 7:
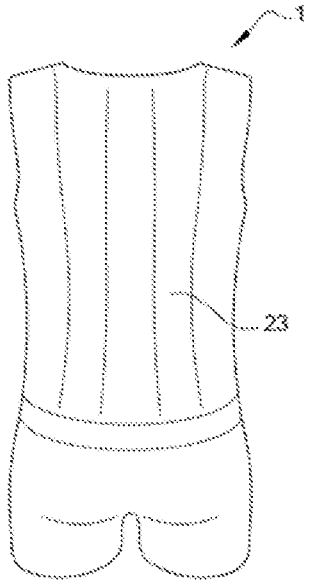
FIG. 7 is a rear perspective view of the swimsuit of FIG. 6.

FIGS. 6 and 7 show a swimsuit 1 according to a second embodiment of the invention. This swimsuit 1 mainly comprises the characteristics described for the swimsuit 1 shown on FIGS. 1 and 2, but is different in that:

it is configured to be worn by an adult, it comprises buoyancy elements 21, 23 which comprise from six to ten 1.2 mm thick sheets 13, the buoyancy element 21 extends on an internal surface of a front side of the swimsuit 1, it is configured to cover an area extending between the pelvis and chest of the adult's body, and comprises from nine to ten sheets 13, and the buoyancy element 23 extends on an internal surface of a rear side of the swimsuit 1, it is configured to cover an area extending between the pelvis and the shoulder line of the adult, and comprises six sheets 13.

The following table shows the buoyancy elements used, as well as the number of sheets they comprise, depending on the adult's weight:

TABLE 2

| Weight | 46-55 kg | 56-65 kg | 66-75 kg | 76-85 kg |
|---|---|---|---|---|
| Element 21 | 9 sheets | 9 sheets | 9 sheets | 10 sheets |
| Element 23 | 6 sheets | 6 sheets | 6 sheets | 6 sheets |

Figure 8:
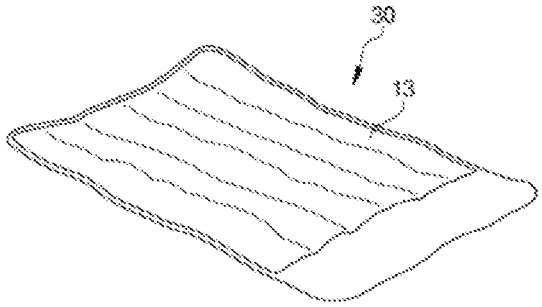
FIG. 8 is a perspective view of a floating mattress according to one embodiment of the invention.

FIG. 8 shows a floating mattress 30, configured to support at least one user on the water, according to one embodiment of the invention. The floating mattress 30 comprises two sheets 13 stacked on top of each other. These sheets 13 are similar in every respect to the sheets 13 described for the swimsuit 1 according to the invention. However, they are different in that they are approximately 5 mm thick. In the embodiment of FIG. 8, the polymer is a low-density polyethylene and the gas 17 is natural gas.

The invention is not limited to the embodiments described and other embodiments will be clearly apparent to those skilled in the art. In particular, it is possible to use sheets made of another polymer, of suitable density and adapted to manufacture flexible products. In addition, the gas used does not have to be natural gas. For example, air or any gas lighter than air can be used.

The invention claimed is:

1. A one-piece safety swimsuit (1), extending from at least the crotch up to the top of the shoulders and comprising:

a main swimsuit part (1), and buoyancy elements (2, 3, 4, 5, 6, 7, 21, 23) each arranged on a portion of the main swimsuit part (1) and configured to keep a user of the swimsuit (1) above water from the shoulders, each buoyancy element (2, 3, 4, 5, 6, 7, 21, 23) comprising several sheets (13) stacked on top of each other, each sheet (13) being from 1.05 mm to 1.50 mm thick, said sheets (13) being composed of polymer fibres (15) enclosing a volume of a gas (17) that is greater than the volume of the polymer, the swimsuit (1) being configured to be worn by a child, wherein the buoyancy elements (2, 3, 4, 5, 6, 7) each comprise from four to fifteen sheets (13), the swimsuit (1) comprising at least:

a buoyancy element (7) extending on a front side of the swimsuit (1), and configured to cover the top part of the child's body, and comprising from fourteen to fifteen sheets (13), and a buoyancy element (3) extending on a rear side of the swimsuit (1), and configured to cover an area extending from the child's pelvis up to the top of the shoulders, and comprising from seven to ten sheets (13).

2. The swimsuit (1) according to claim 1, configured to be worn by a child weighing between 13 and 19 kg, the swimsuit (1) further comprising:

a buoyancy element (2) extending on a front side of the swimsuit (1), and configured to cover a child's waistline, and comprising four sheets (13), and a buoyancy element (4) extending on a rear side of the swimsuit (1), and configured to cover the child's waistline, and comprising seven or eight sheets (13).

3. The swimsuit (1) according to claim 2, configured to be worn by a child weighing between 13 and 15 kg, the swimsuit (1) further comprising a buoyancy element (5) extending on a rear side of the swimsuit (1), and configured to cover an area of the child's biceps, and comprising twelve sheets (13).

4. The swimsuit according to claim 2, configured to be worn by a child weighing between 15 and 19 kg, the swimsuit further comprising a buoyancy element (6) extending on a rear side of the swimsuit (1), and configured to cover the child's nape, and comprising four sheets (13).

5. The swimsuit (1) according to claim 1, configured to be worn by a child weighing between 19 and 21 kg, the swimsuit further comprising a buoyancy element (6) extending on a rear side of the swimsuit, and configured to cover the child's nape, and comprising four sheets.

6. The swimsuit (1) according to claim 1, wherein the polymer is an ethylene polymer.

7. The swimsuit (1) according to claim 1, wherein the gas (17) is air or natural gas.

8. The swimsuit (1) according to claim 6, wherein the gas (17) is air or natural gas.

9. A one-piece safety swimsuit (1), extending from at least the crotch up to the top of the shoulders and comprising:

a main swimsuit part (1), and buoyancy elements (2, 3, 4, 5, 6, 7, 21, 23) each arranged on a portion of the main swimsuit part (1) and configured to keep a user of the swimsuit (1) above water from the shoulders, each buoyancy element (2, 3, 4, 5, 6, 7, 21, 23) comprising several sheets (13) stacked on top of each other, each sheet (13) being from 1.05 mm to 1.50 mm thick, said sheets (13) being composed of polymer fibres (15) enclosing a volume of a gas (17) that is greater than the volume of the polymer, the swimsuit being configured to be worn by an adult, wherein the buoyancy elements (21, 23) comprise from six to ten sheets (13), and comprising:

a buoyancy element (21) extending on a front side of the swimsuit (1), and configured to cover an area extending between the pelvis and chest of the adult's body, and comprising from nine to ten sheets (13), a buoyancy element (23) extending on a rear side of the swimsuit, and configured to cover an area extending between the pelvis and the shoulder line of the adult, and comprising six sheets (13).

10. Swimsuit (1) according to claim 9, wherein the polymer is an ethylene polymer.

11. Swimsuit (1) according to claim 9, wherein the gas (17) is air or natural gas.

12. Swimsuit (1) according to claim 10, wherein the gas (17) is air or natural gas.

* * * * *